US009163298B2

(12) United States Patent
Frederiksen et al.

(10) Patent No.: US 9,163,298 B2
(45) Date of Patent: Oct. 20, 2015

(54) METHOD AND APPARATUS FOR CONDENSING METAL VAPOURS USING A NOZZLE AND A MOLTEN COLLECTOR

(75) Inventors: Jens Sonderberg Frederiksen, Svendborg (DK); Peter Saxby, Luxembourg (LU); Jean-Raymond Boulle, Luxembourg (LU); Robert R. Odle, Elkton, MD (US)

(73) Assignee: Boulle Carbothermic Metals Ltd, Tortola (VG)

( * ) Notice: Subject to any disclaimer, the term of this patent is extended or adjusted under 35 U.S.C. 154(b) by 590 days.

(21) Appl. No.: 13/503,865

(22) PCT Filed: Oct. 27, 2010

(86) PCT No.: PCT/GB2010/001999

§ 371 (c)(1),
(2), (4) Date: Aug. 14, 2012

(87) PCT Pub. No.: WO2011/051674

PCT Pub. Date: May 5, 2011

(65) Prior Publication Data

US 2012/0297930 A1 Nov. 29, 2012

(30) Foreign Application Priority Data

Oct. 27, 2009 (GB) ..... 0918847.5

(51) Int. Cl.

| | |
|---|---|
| ***C22B 9/00*** | (2006.01) |
| ***C22B 26/22*** | (2006.01) |
| ***C22B 19/18*** | (2006.01) |
| ***C22B 5/16*** | (2006.01) |
| ***C22B 5/10*** | (2006.01) |

(52) U.S. Cl.
CPC ... *C22B 5/16* (2013.01); *C22B 5/10* (2013.01); *C22B 19/18* (2013.01); *C22B 26/22* (2013.01)

(58) Field of Classification Search
CPC ..... C22B 26/22; C22B 19/18; C22B 9/00
USPC ..... 75/414, 595, 665, 668
See application file for complete search history.

(56) References Cited

U.S. PATENT DOCUMENTS

| | | | |
|---|---|---|---|
| 2,295,226 | A | 9/1942 | Long |
| 2,416,255 | A | 2/1947 | Griswold, Jr. |
| 2,473,304 | A | 6/1949 | Stanley |
| 2,950,236 | A | 8/1960 | Lloyd et al. |
| 3,661,737 | A | 5/1972 | Scherer |

(Continued)

FOREIGN PATENT DOCUMENTS

| | | | |
|---|---|---|---|
| CN | 101128608 | A | 2/2008 |
| EP | 0 124 634 | | 11/1984 |

(Continued)

OTHER PUBLICATIONS

Schwartz, Harold. ProKon Version 8.6. The Calculation Corporation. 1997-1998.*

(Continued)

*Primary Examiner* — George Wyszomierski
*Assistant Examiner* — Tima M McGuthry Banks
(74) *Attorney, Agent, or Firm* — Ballard Spahr LLP

(57) ABSTRACT

Methods and apparatus are disclosed for condensing vapor phase compounds or elements, typically metals such as magnesium, obtained by reduction processes.

27 Claims, 6 Drawing Sheets

(56) References Cited

U.S. PATENT DOCUMENTS

| | | | | |
|---|---|---|---|---|
| 3,761,248 | A | 9/1973 | Avery | |
| 4,147,534 | A | 4/1979 | Hori | |
| 4,200,264 | A | 4/1980 | Hori | |
| 4,488,904 | A | 12/1984 | Miura et al. | |
| 4,695,319 | A * | 9/1987 | Miura et al. | 75/588 |
| 5,258,055 | A | 11/1993 | Pargeter et al. | |
| 5,803,947 | A | 9/1998 | Engell et al. | |
| 2008/0115626 | A1 | 5/2008 | Schoukens et al. | |

FOREIGN PATENT DOCUMENTS

| | | | |
|---|---|---|---|
| EP | 0 124 635 | | 11/1984 |
| EP | 0668935 | A1 | 8/1995 |
| GB | 550 732 | | 1/1943 |
| GB | 0918847.5 | | 10/2009 |
| JP | S58-123840 | | 7/1983 |
| JP | 62 099423 | | 5/1987 |
| JP | 62099423 | A | 5/1987 |
| JP | 63125627 | A | 5/1988 |
| JP | 2007-126720 | A | 5/2007 |
| WO | WO-94/11539 | A1 | 5/1994 |
| WO | WO-03/048398 | A1 | 6/2003 |
| WO | WO-2006/079125 | A1 | 7/2006 |
| WO | WO-2008/005920 | A2 | 1/2008 |
| WO | WO 2010/012042 | | 2/2010 |
| WO | WO-2011/051674 | A2 | 5/2011 |

OTHER PUBLICATIONS

International Search Report issued on Apr. 28, 2011 for Intl. App. No. PCT/GB2010/001999, filed Feb. 17, 2011 (Inventor—Frederiksen et al.; Applicant—Magnesium Silica Ltd.; pp. 1-7).

International Preliminary Report on Patentability on Mar. 28, 2012 for Intl. App. No. PCT/GB2010/001999, filed Feb. 17, 2011 (Inventor—Frederiksen et al.; Applicant—Magnesium Silica Ltd.; pp. 1-27).

Written Opinion issued on Apr. 28, 2011 for Intl. App. No. PCT/GB2010/001999, filed Feb. 17, 2011 (Inventor—Frederiksen et al.; Applicant—Magnesium Silica Ltd.; pp. 1-9).

Examination Report mailed Sep. 16, 2014 by the Japanese Patent Office for Application No. 2012/535923 (Applicant—Magnesium Silica LTD) (7 pages).

Office Action issued Sep. 16, 2014 by the State IP Office of China for Application No. 201080048912.6 (Applicant—Magnesium Silica LTD) (14 pages).

* cited by examiner

METHOD AND APPARATUS FOR CONDENSING METAL VAPOURS USING A NOZZLE AND A MOLTEN COLLECTOR

CROSS-REFERENCE TO RELATED APPLICATIONS

The present application is a National Phase Application of International Application No. PCT/GB2010/001999, filed Oct. 27, 2010, which claims priority to Great Britain Patent Application No. 0918847.5 filed Oct. 27, 2009, and which applications are incorporated herein fully by this reference.

BACKGROUND

The present invention concerns the condensing of vapour phase compounds or elements, typically metals such as magnesium, obtained by reduction processes. These include metallothermic and carbothermic processes. The invention in particular concerns a process and apparatus for condensing and collecting metal and other vapours by the use of an expansion nozzle.

Magnesium extraction from its mineral ores has been the subject of scientific and technical studies over more than a hundred years. Magnesium metal extraction has drawn particular interest and effort due to this metal's material properties as an important alloying element in aluminium and other metals. Furthermore in recent years, magnesium has become important as a lightweight, yet strong structural material in its own right, particularly in the automobile industry. The method of extraction has followed two lines, i.e. electrolytic reduction of water-free molten salts, or pyro-metallurgical routes involving the reduction of oxide and carbonate forms of the metal, using carbon or metal reduction agents.

The main technical problems in magnesium metal manufacture in general are not only related to the need for continous high energy inputs due to the metal's inherently strong negative electrode potential. For the pyro-metallurgical routes there is additionally the necessity of a high reaction temperatures to initiate and maintain the reduction process, which however can be obtained with appropriate choice of furnace type. In the pyro-metallurgical routes, there are two categories of reductants: carbon (in carbothermic reduction) and certain metals (in metallothermic reduction). In the high temperatures regimes employed in both cases, the reduced metal will appear in gaseous form, either alone as in metallothermic processes, or together with carbon monoxide in carbothermic reductions. Typical reducing agents are solid, liquid or gaseous forms of other metals, carbon, hydrocarbons or other organically derived materials, and hydrogen. When the reduced metal coexists with the oxide form of the reductant at high temperatures, it can only be stabilised in metal form at lower temperatures when it is cooled very fast to below its melting point.

An inherent problem of cooling a hot gas containing both the reduced gas in metallic form, and the oxide form of the reductant, is that the gas mix on cooling reverses the reaction (back reaction) so that the resulting product can be wholly or partly reverted to metal oxide and the elemental reductant. For example, if carbon is used as the reductant, the primary reduction reaction is given by:

$$C(s)+MgO(s)\rightarrow CO(g)+Mg(g) \qquad \text{Eq.[1]}$$

This reaction is favourable in the temperature range of 1600 to 1900° C., depending on total pressure in the gas; it is valid at the lower end of the temperature range by reducing the pressure of the gas through evacuation, or through the addition of appropriately heated inert gas.

Upon cooling of the gas, the following reaction occurs in whole or in part:

$$CO(g)+Mg(g)\rightarrow C(s)+MgO(s) \qquad \text{Eq.[2]}$$

Since any chemical reaction takes time, condensing systems for this type of metallurgical processing rely on swift or "instant" cooling so that back reactions are reduced to a minimum. To achieve swift cooling of a gas several methods are known in the art; however, the present invention preferably makes use of a device known as de Lavalle adiabatic nozzle, schematically depicted in FIG. 6 hereinafter.

Passing the hot reaction reaction gasses through a nozzle as depicted in FIG. 6, rapid cooling can be achieved as indicated in Table 1 below. The gases are accelerated to the speed of sound as they pass through the nozzle. The temperature of the gas drops from reaction temperatures to a temperature determined by the pressure differential across the nozzle and its geometry, as known in the art. This cooling occurs in the residence time indicated in the third column in Table 1 for various length nozzles.

TABLE 1

Residence Times of Gases in a Nozzle of Different Lengths

| Nozzle neck length (cm) | Gas speed m/s | Residence time in seconds |
|---|---|---|
| 1 | 997.2 | 1.00282E−05 |
| 2 | 997.2 | 2.00563E−05 |
| 5 | 997.2 | 5.01408E−05 |
| 6 | 997.2 | 6.01689E−05 |
| 10 | 997.2 | 0.000100282 |
| 15 | 997.2 | 0.000150422 |
| 20 | 997.2 | 0.000200563 |

Cp/Cv = 5/3 for monoatomic gas (Mg)

Cp/Cv = 7/5 for di-atomic gas (CO)

Gamma = Cp/Cv

Speed of Sound = $(\text{gamma} * R/nT)^{1/2}$, where R is the gas constant, and T is the temperature in degrees Kelvin.

U.S. Pat. No. 3,761,248 discloses the metallothermic production of magnesium which involves the condensation of magnesium vapour evolved from a furnace in a condenser. The condensation is promoted using a flowing inert gas to draw the vapour into the condenser.

WO 03/048398 discloses a method and apparatus for condensing magnesium vapours in which a stream of vapour is directed into a condenser which has a lower crucible section from which liquid magnesium may be tapped. A molten lead jacket is used to cool the crucible section.

US application 2008/0115626 discloses the condensation of magnesium vapour in a sealed system in which liquid metal is continuously tapped from a crucible portion.

U.S. Pat. No. 5,803,947 discloses a method for producing magnesium and magnesium oxide. A condenser for the collection of magnesium liquid is fed via a converging/divergent nozzle for supersonic adiabatic cooling of the gas passing through the nozzle. No details are given of the structure or configuration of the nozzle and condenser, although it is stated that a cyclone is used to precipitate particles entrained in a carrier gas downstream of the nozzle.

Descriptions of adiabatic cooling systems per se are known; vide e.g. "Compressible Fluid Flow" Authored by Patrick H. Oosthuizen et al., 1997, ISBN 0-07-048197-0, McGraw-Hill Publishers.

U.S. Pat. No. 4,488,904 discloses a method in which metallic vapour (such as magnesium) is directed through a convergent-divergent nozzle which cools the metal to a level at which oxidation will not take place. The metallic vapour is directly or indirectly led onto a metal retrieving pool which, in the case of magnesium collection, comprises molten lead, bismuth, tin, antimony or a mixture thereof. EP-A-0 124 65 similarly discloses a method for collecting liquid metal (magnesium) from vapour via an adiabatic nozzle. In this document the vapour is collected in a pool of molten magnesium.

JP-A-63125627 discloses a method of forming metal matrix composite material in which a metal vapour is directed through an adiabatic nozzle. A reactive gas is introduced into the nozzle so as to react with the metal and form particulate metal compound. The compound is directed from the nozzle into a metal pool of the metal matrix material. Hence a dispersion of metal compound particles in a metal matrix is formed.

U.S. Pat. No. 4,147,534 discloses a method for the production of Magnesium (or Calcium) in which a metal vapour is passed through an adiabatic nozzle and directed onto a cooled surface, which may be a rotating cylindrical surface in one embodiment. The solidified magnesium particles are scraped from the surface and fall into a screw conveyor which leads to a furnace for melting the particles. The molten magnesium then falls into a collection reservoir.

JP-A-62099423 discloses apparatus for collecting metal vapour directed from an adiabatic valve. A collection pool is provided with a perforated tray or grid over which molten metal is circulated so as to collect metal vapour and reflect oxidizing gas.

Problems arise in the prior art processes in several areas. One is the oxidation or contamination of the condensed droplets or particles in the condensing chamber. Another is oxidation or contamination of the liquid metal collected from the nozzle, in both cases due to carrier or reaction gasses present in the condensing chamber.

Another problem concerns the efficient adsorption of the particles or droplets into bulk liquid when at the localised region of the liquid in which the beam of condensed droplets or particles impinges.

The present invention its various aspects seeks to solve one or more of the above problems in one or more ways. The solutions and other benefits of the invention will be evident to the skilled person from the following description of the invention.

DESCRIPTION OF THE PRESENT INVENTION

According to the present invention there are provided methods and apparatus for condensing vapour, in particular metal vapour, as set forth in the claims hereinafter.

According to one aspect of the present invention there is provided a method for condensing a metal vapour or a vapourous metal containing compound such as metal vapour comprising: providing a gas stream comprising the vapour, passing the gas stream into a condensing chamber via a nozzle which has an upstream converging configuration and a downstream diverging configuration so that the metal vapour accelerates into the nozzle and expands and cools on exiting the nozzle thereby inducing the vapour to condense to form a beam of liquid droplets or solid particles in the condensing chamber, wherein the beam of droplets or particles is directed to impinge onto a collection medium surface.

In a further aspect of the invention there is provided apparatus for condensing metal vapour from a source of gas comprising the metal vapour and one or more other gases, a condensing chamber fed from the vapour source by a de Lavalle nozzle which has an upstream converging configuration and a downstream diverging configuration so that vapour entering the nozzle accelerates into the nozzle and expands and cools on exiting the nozzle thereby inducing the vapour to condense to form a beam of liquid droplets or solid particles in the condensing chamber, and a bath comprising a collection medium for the liquid droplets or particles, the collection medium having an exposed surface portion which is disposed so as to permit a beam of droplets or particles exiting the nozzle to impinge thereupon.

In addition to the metal vapour being condensed, for the purpose of the present description two other types of gases are defined as follows, a reactive gas that has participated in the reduction reactions or which has been a product of the reduction reactions and a carrier gas which is defined as any gas added to the vapour source that does not significantly react with the other gases present or with the metal vapour. An injected noble gas is one example of a carrier gas.

This invention concerns the effective capture of metal mist from a high velocity gas stream by impinging the gas stream on a molten salt or molten metal. In particular, it concerns the collection of metal vapours from the low pressure exit of a de Lavalle nozzle to facilitate the effective recovery of metals from a precursor mineral mixture, which is treated at elevated temperature with a reducing agent to obtain the selected metal in elemental form.

The metal droplets are typically a fine mist with droplet sizes varying from aerosol sized particles to discrete droplets up to 1 mm in diameter.

The invention is specifically focused on obtaining the metal in a liquid form in order to facilitate transfer of the recovered metal from a condenser vessel to a casting or alloying shop without the need to open up the condenser.

The transfer can be done by pumping at regular intervals, or continuously, thereby reducing re-oxidation losses, facilitating environmental control of vapours and gases and safe handling of easily oxidized metals.

In the following paragraphs magnesium is used as example of a metal that can be recovered according to the invention, but the invention concerns all other metals appearing at high temperatures on vapour form either alone or in combination with other gases.

The system described can in principle be used for any metal which can occur as metallic vapour upon reduction, for example Zn, Hg, Sn, Pb, As, Sb, Bi, Si, S, and Cd, or combinations thereof.

The collection medium is typically a molten salt or molten metal bath. The molten salt should preferably have a specific gravity which is lower than that of the metal being processed so that the metal settles below the molten bath.

As an example, salt compositions that meet this requirement are given in Table 1 (below). In addition, the densities of the various salt mixtures at three different temperatures are also shown. The density of magnesium in this temperature range, from 750° C. to 900° C. is 1.584 gm/cc to 1.52 gm/cc, see Table 1. The temperature of the salt bath is kept above the melting point of magnesium, which is 650° C.

TABLE 1

| Composition of Salts (wt. %) | | | | | |
|---|---|---|---|---|---|
| MgCl2 | LiCl + 1% CaF2 | KCl | 750° C. | 800° C. | 900° C. |
| 6.8 | 90 | 3.1 | 1.47 | 1.45 | 1.39 |
| 10.0 | 85 | 5.0 | 1.49 | 1.47 | 1.42 |
| 14.6 | 80 | 6.4 | 1.49 | 1.47 | 1.42 |
| 17.0 | 75 | 8.0 | 1.50 | 1.48 | 1.43 |
| 20.4 | 70 | 9.6 | 1.51 | 1.49 | 1.44 |
| 24.0 | 65 | 11.0 | 1.52 | 1.49 | 1.45 |

TABLE 1-continued

| Composition of Salts (wt. %) | | | | | |
|---|---|---|---|---|---|
| MgCl2 | LiCl + 1% CaF2 | KCl | 750° C. | 800° C. | 900° C. |
| 26.2 | 60 | 13.8 | 1.52 | 1.50 | 1.46 |
| 30.6 | 55 | 14.4 | 1.53 | 1.51 | 1.46 |
| 34.0 | 50 | 16.0 | 1.53 | 1.52 | 1.47 |
| 100 percent magnesium metal | | | 1.567 | 1.557 | 1.518 |
| Reference: U.S. Pat. No. 2,950,236 | | | | | |

The molten metal bath can be of the same metal as the metal being condensed through the nozzle and therefore having identical specific gravity or a lighter metal which is imiscible with the the metal being condensed. In the preferred embodiment the bath contains a molten salt which is typically maintained at a temperature which is above the melting point of the condensed metal.

The collection medium is preferably a moving liquid. The metal mist from a conventional de Lavalle nozzle with its rotational symmetrical form delivers a collapsing cone form, as will be explained below. When the beam impacts the medium, the medium surface is constantly renewed and hot droplets and particles are continuously removed. Thus both heat and mass are transferred away from the impingement site so that local over-heating and vaporisation of the metal is prevented.

In one embodiment the moving liquid is a stream of liquid, preferably falling under gravity. This may be achieved by use of a weir over which liquid collection medium is allowed to fall. This can create a moving veil surface. In a variation of this embodiment the liquid salt falls through holes in a cylindrical tube with it's rotational axis parallel to the rotational axis of the nozzle. The diameter of the tube is adjusted to accommodate the entire cone formed condensing metal mist.

In another embodiment the moving liquid is a circulating bath of liquid. In this case the vessel which contains the bath may be generally cylindrical or annular, and provided with a mechanical or induction stirrer, or pumping means or the like.

Turning now to the operation of the nozzle, the phase change from high temperature metal vapour to lower temperature and much lower volume liquid of solid particles, causes the mist cone formed by the condensing species to collapse to a sharper conical beam than for the reactive or carrier gases present in the vapour source on the inlet of the nozzle. The metal droplets or particles that form have a combined volume can be estimated from the ideal gas law, as shown in Table 2 below.

TABLE 2

Calculation of Volume Change from Free Gas Above the Boiling Point of Magnesium to Solid/Liquid Condensate, Below The Boiling Point of Magnesium Ideal gas law:

$P \times V = nRT$ (eq. 3)
Reynolds number $R = 0.0821$ L atm $K^{-1}$ $mol^{-1}$
P = pressure atmospheres (atm)
V = volume in litres (L)
n = moles of gas
T = temperature in degrees Kelvin
1 mole magnesium n = 24.3050 grams
At constant p = 1 atm and for 1 mole Mg
V = RT (eq. 4)

| Density of magnesium (solid) | | |
|---|---|---|
| at 20° C. | g/cm3 | 1.738 |
| at 600° C. | g/cm3 | 1.622 |
| Density at mp 650° C. | | |
| liquid | g/cm3 | 1.584 |

| | | | P = 1 atm | | | p = 0.1 atm | p = 0.01 atm. |
|---|---|---|---|---|---|---|---|
| T ° Celsius | °K | 1 mole volume V (litres) | Volume Ratio Gas/solid* | 600° C. Ratio Gas/solid* | 650° C. Ratio gas/liquid | 650° C. Ratio Gas/liquid | 650° C. Ratio Gas/liquid |
| 1200 | 1473.15 | 120.95 | 8,649 | 8,071 | 7,882 | 78,822 | 788,224 |
| 1220 | 1493.15 | 122.59 | 8,766 | 8,181 | 7,989 | 79,893 | 798,925 |
| 1240 | 1513.15 | 124.23 | 8,883 | 8,290 | 8,096 | 80,963 | 809,626 |
| 1260 | 1533.15 | 125.87 | 9,001 | 8,400 | 8,203 | 82,033 | 820,328 |
| 1280 | 1553.15 | 127.51 | 9,118 | 8,510 | 8,310 | 83,103 | 831,029 |
| 1300 | 1573.15 | 129.16 | 9,236 | 8,619 | 8,417 | 84,173 | 841,730 |
| 1320 | 1593.15 | 130.80 | 9,353 | 8,729 | 8,524 | 85,243 | 852,431 |
| 1340 | 1613.15 | 132.44 | 9,470 | 8,838 | 8,631 | 86,313 | 863,132 |
| 1360 | 1633.15 | 134.08 | 9,588 | 8,948 | 8,738 | 87,383 | 873,834 |
| 1380 | 1653.15 | 135.72 | 9,705 | 9,058 | 8,845 | 88,453 | 884,535 |
| 1400 | 1673.15 | 137.37 | 9,823 | 9,167 | 8,952 | 89,524 | 895,236 |
| 1420 | 1693.15 | 139.01 | 9,940 | 9,277 | 9,059 | 90,594 | 905,937 |
| 1440 | 1713.15 | 140.65 | 10,058 | 9,386 | 9,166 | 91,664 | 916,639 |
| 1460 | 1733.15 | 142.29 | 10,175 | 9,496 | 9,273 | 92,734 | 927,340 |
| 1480 | 1753.15 | 143.93 | 10,292 | 9,605 | 9,380 | 93,804 | 938,041 |
| 1500 | 1773.15 | 145.58 | 10,410 | 9,715 | 9,487 | 94,874 | 948,742 |
| 1520 | 1793.15 | 147.22 | 10,527 | 9,825 | 9,594 | 95,944 | 959,443 |
| 1540 | 1813.15 | 148.86 | 10,645 | 9,934 | 9,701 | 97,014 | 970,145 |
| 1560 | 1833.15 | 150.50 | 10,762 | 10,044 | 9,808 | 98,085 | 980,846 |
| 1580 | 1853.15 | 152.14 | 10,879 | 10,153 | 9,915 | 99,155 | 991,547 |

TABLE 2-continued

Calculation of Volume Change from Free Gas Above the Boiling Point of Magnesium to Solid/Liquid Condensate, Below The Boiling Point of Magnesium

| | | | | | | | |
|---|---|---|---|---|---|---|---|
| 1600 | 1873.15 | 153.79 | 10,997 | 10,263 | 10,022 | 100,225 | 1,002,248 |
| 1620 | 1893.15 | 155.43 | 11,114 | 10,372 | 10,129 | 101,295 | 1,012,949 |
| 1640 | 1913.15 | 157.07 | 11,232 | 10,482 | 10,237 | 102,365 | 1,023,651 |
| 1660 | 1933.15 | 158.71 | 11,349 | 10,592 | 10,344 | 103,435 | 1,034,352 |
| 1680 | 1953.15 | 160.35 | 11,467 | 10,701 | 10,451 | 104,505 | 1,045,053 |
| 1700 | 1973.15 | 162.00 | 11,584 | 10,811 | 10,558 | 105,575 | 1,055,754 |
| 1720 | 1993.15 | 163.64 | 11,701 | 10,920 | 10,665 | 106,646 | 1,066,455 |
| 1740 | 2013.15 | 165.28 | 11,819 | 11,030 | 10,772 | 107,716 | 1,077,157 |
| 1760 | 2033.15 | 166.92 | 11,936 | 11,140 | 10,879 | 108,786 | 1,087,858 |
| 1780 | 2053.15 | 168.56 | 12,054 | 11,249 | 10,986 | 109,856 | 1,098,559 |
| 1800 | 2073.15 | 170.21 | 12,171 | 11,359 | 11,093 | 110,926 | 1,109,260 |

*solid at 20° C.

Table 2 above illustrates the volume change which at the preferred magnesium partial pressure will be between 7,000 and 70,000 times less for the condensed magnesium compared to the gaseous magnesium.

Hence, in one aspect of the invention on exiting the nozzle, the condensed droplets or particles form a first cone (collapsing cone) while the reactive or carrier gases that are present forms a second cone with the angle of divergence of the first cone being less than an angle of divergence of the second cone, so that the first cone is inside the second cone.

A baffle may be provided and positioned so that in use it extends around the first cone and inside the first cone. This helps in separating the droplets or particles from the gas species. The baffle may be a cylindrical sleeve or collar through which the inner first cone from the nozzle passes before impinging the collection medium. Other physical barriers may however be used.

Alternatively, or in addition, the separation of gas species and droplets/particles may be improved by providing a flange or plate around the baffle so that the collection medium surface is shielded from the reactive and carrier gases in the outer cone. A suction port is provided to draw the reactive and carrier gas outside of the condenser chamber.

In a preferred aspect of the invention the beam of droplets or particles impinges onto the collection medium at an oblique angle (i.e. not perpendicular) with respect to the collection medium surface. This may be achieved by angling of the nozzle orientation and/or by creating a sloped collection medium surface.

Thus, when the collection medium is a circulating molten bath inside an inverted cone formed vessel, the circulation may in the molten salt surface induce an inverted coaxial cone (of parabaloid shape), which provides an oblique surface to receive the droplet or particle beam.

The beam impingement may be used to drive the circulation of the collection medium. Thus the nozzle may be directed to impinge onto the collection medium at a location radially spaced apart from a central rotational axis of the bath, thereby assisting or causing circumferential flow of the molten bath.

The nozzle is preferably a de Lavalle nozzle, which is a nozzle well known in the field of gas propulsion systems such as turbines and rocket engines. The nozzle usually has an hourglass longitudinal cross-section with a pinched middle portion. At appropriate differential pressure between inlet portion of the nozzle and outlet partion of the nozzle, the gas accelerates to supersonic speeds in the pinched section before spreading out and cooling when leaving the outlet portion of the nozzle.

The upstream side of the nozzle operates at near atmospheric pressure and the closed condenser vessel at the downstream side of the nozzle is kept at a lower pressure by the vacuum pump which communicates with the interior of the condenser vessel. Alternatively, or in addition, steam ejectors may be used to provide an efficient means of gas evacuation.

In a well designed adiabatic nozzle, using the dimensions and geometry as described in above cited literature (Oosthuizen et al), the individual atoms/molecules of the gas components will speed up to the speed of sound in the neck portion and freely expand the gas on the down stream side. The expansion causes a temperature drop of the gas mixture following the gas laws.

The metal droplets in the beam may in one embodiment be cooled to form solid particles before impinging on the collection medium. The formation of solid particles does not reduce the heat transferred to the collection medium since the additional heat absorbed by the enthalpy of solidification is offset by a higher velocity of the solid particles compared to the liquid particle via the conservation of energy principal. However, the higher velocity particles will penetrate deeper into the salt bath facilitating heat transfer to the bath.

It is important to control the temperature accurately inside the collection box to keep the metal in the liquid phase.

Impacting metal droplets will heat up the salt bath, heat energy being approximately equal to the heat of vaporization of liquid magnesium to magnesium vapour. This is relatively large amount of heat, in the order of 10 kilowatt hours of energy per kilogram of magnesium. Therefore the collection medium needs to be effectively cooled to prevent liquid metal from the beam re-vapourizing.

This is a particular problem in the impingement location, so circulation or transport of the collection medium is important. The cooling means may be of a type known in the art, such as cooling jackets or coils. A heat exchange fluid may be a liquid metal or steam (or other gas) or water. The cooling liquid may alternatively have solid particles added in separate vessel connected to the cooling circuit. When selected on the basis of appropriate melting point, such particles can improve cooling capacity of the cooling liquid and act as buffer heat sink due to latent heat of fusion. A convenient material could be solid particles of the same metal that is being condensed.

The sensible heat that the salt can absorb is established by the amount of salt, or more precisely the heat capacity ratio of the mass of salt to the mass of magnesium when looking at the volume in which the heat is transferred from the metal to the salt. The lower temperature of the salt, for the system described herein, must be above the melting point of the salt, or more precisely, above a temperature at which the salt becomes fluid (low viscosity) enough for pumping and above the melting point of the metal (magnesium 650° C.). The upper temperature range of the salt must be below the boiling point of the metal (magnesium=1091° C.).

This means that the temperature window available for the molten salt to be kept functional is only a few hundred degrees within which heat from the magnesium can be absorbed efficiently. Assuming the same sensible heat capacity of salt and liquid magnesium, the ratio of salt to the mass amount of magnesium must be more than ten to one, depending on temperature difference between furnace gas and salt bath.

The collection box should preferably be equipped with means to control the pressure and to remove the gases accompanying the metal stream.

The absolute pressure in the collection box should be maintained at a predetermined level to control the pressure drop across the nozzle and the temperature of the metal stream that is formed. The temperature of the metal stream must be maintained below the boiling point of the metal (e.g. magnesium 1093° C.), but more preferably near its melting point (650° C. for Mg) or above. The absolute pressure will be below about 0.1 atmospheres but typically above 0.01 atmospheres. The reduced pressure can be maintained by methods commonly employed by those skilled in the art.

In a preferred embodiment the collection medium is typically a molten salt having a lower specific gravity than the liquid metal. Collected liquid metal should be continuously or intermittently tapped from the collection medium so as to draw heat therefrom. In a preferred system, the molten metal is transferred to an alloying stage and/or casting stage or other metal forming stage.

Thus, means may be provided for tapping the condensed liquid continuously or intermittently from the collection medium and conveying the liquid metal to a casting stage or alloying stage or other metal forming stage. Such means may comprise a fluid conduit and associated flow control valves.

The vapour may be a metal or metallic material, for example selected from Mg, Zn, Sn, Pb, As, Sb, Bi, Si and Cd or combinations thereof. In a preferred embodiment the metal is magnesium.

Typically the source of vapour is a metallothermic or carbothermic reduction process or apparatus.

The carrier gas can be a gas which was involved in the reduction reaction and/or one or more further gases added or introduced into the gas/vapour stream. The further gas(es) can conveniently be introduced by gas injection.

In one embodiment, the present disclosure provides a method for condensing a vaporous material comprising providing a gas stream comprising the vapour, passing the gas stream through a nozzle which has an upstream converging configuration and a downstream diverging configuration so that the vapour accelerates into the nozzle and expands and cools on exiting the nozzle thereby inducing the vapour to condense to form a beam of liquid droplets or solid particles in the condensing chamber, wherein the beam of droplets or particles is directed to impinge onto a molten liquid collection medium. In another embodiment, the present disclosure provides a method as described above, wherein the collection medium is maintained at a temperature above the melting point of the condensed vaporous material. In another embodiment, the present disclosure provides a method as described above, wherein the collection medium is a molten bath. In yet another embodiment, the present disclosure provides a method as described herein, wherein the collection medium comprises a salt flux which has a specific gravity lower than that of the condensed vaporous.

In another embodiment, the present disclosure provides a method as described above, wherein the liquid collection medium comprises a thin sheet of a first liquid disposed above a second liquid, the sheet being sufficiently thin to be disrupted by impinging condensed droplets or particles, to the extent that the sheet parts in a region corresponding to the impingement so as to reveal a surface of the second liquid so as to permit direct access of the condensed particles or droplets to the underlying second liquid for absorption therein, and wherein the thin sheet remains as a protective covering over a remaining portion of the surface of the second liquid. In a further embodiment, the first liquid comprises a salt flux. In another further embodiment, the second liquid comprises liquid condensed vaporous material. In yet another further embodiment, the second liquid is a molten metal. In still another embodiment, the collection medium comprises a moving sheet of liquid. In a further embodiment, the moving sheet is a stream of liquid falling under gravity. In yet another embodiment, the moving sheet is provided by an overflowing ledge region of a collection medium reservoir.

In another embodiment, the nozzle is directed horizontally or substantially horizontally towards the sheet of liquid collection medium. In another embodiment, the nozzle has an elongated transverse waist region so as to provide a generally planar or wedge-shaped output beam of condensed particles or liquid. In another embodiment, the collection medium is disposed as a circumferentially circulating bath of liquid. In yet another embodiment, the liquid is circulated by mechanical means, such as a stirrer.

In another embodiment, the gas stream comprises a reaction gas and/or a non-reactive carrier gas in addition to the vapour to be condensed. In another embodiment, the condensed droplets or particles form a first cone on exiting the nozzle, the reaction gas and/or carrier gas form at least one further cone with the first cone accommodated inside the second cone and wherein a baffle means is provided around the first cone and substantially inside the further cone so as to provide a physical barrier which helps separate the carrier gas and other remaining gaseous species from the droplets or particles which pass through the baffle into the collection medium. In another embodiment, a baffle means is provided comprising an axially elongate conduit, the walls of which provide separation of the first cone. In yet another embodiment, the baffle means is surrounded by a shoulder which covers at least a portion, or all of, the remaining surface of collection medium.

In another embodiment, the present disclosure provides a method wherein a beam of droplets or particles impinges onto the collection medium at an oblique angle with respect to the medium surface. In another embodiment, the collection medium is disposed in a circumferentially circulating molten bath. In yet another embodiment, the bath circulation induces an inverted coaxial centrifugal cone to form in an upper surface of the bath, which cone provides an oblique surface to receive the droplet or particle beam. In still another embodiment, the oblique beam impinges onto the collection medium at a location radially spaced apart from a central rotational axis of the bath, thereby assisting or causing circumferential flow of the molten bath. In yet another embodiment, metal droplets in the beam are cooled to form solid particles before impinging on the collection medium.

In another embodiment, the present disclosure provides a method wherein the collection medium is cooled so as to prevent liquid metal from the beam vaporizing. In another embodiment, the collection medium comprises a liquid having a lower specific gravity than the condensed liquid material, which condensed liquid material is continuously or intermittently tapped from a collection medium reservoir and directed without intermediate solidification to a casting stage or alloying stage or, other forming stage. In another aspect, the vaporous material to be condensed is, or comprises, magnesium.

In another embodiment, the present disclosure provides a method as described herein, wherein the vapour comprises a metal or metallic material. In such an embodiment, the vapour can be selected from the group comprising Mg, Zn, Sn, Pb, As, Sb, Bi, Si, Cd, and combinations thereof. In still another embodiment, the source of vapour can be provided by a metallothermic or carbothermic reduction apparatus and/or process.

In another aspect, the present disclosure provides an apparatus for condensing vapour such as a metal comprising a source of gas comprising the vapour, a condensing chamber fed from the vapour source by a nozzle which has an upstream converging configuration and a downstream diverging configuration so that vapour entering the nozzle accelerates into the nozzle and expands and cools on exiting the nozzle thereby inducing the vapour to condense to form a beam of liquid droplets or solid particles in the condensing chamber, and a liquid collection medium for the liquid droplets or particles, the collection medium having an exposed surface portion which is disposed so as to permit a beam of droplets or particles exiting the nozzle to impinge thereupon. In another embodiment, the collection medium is a molten liquid. In yet another embodiment, the collection medium is a salt flux. In yet another embodiment, the collection medium is disposed in a bath.

In another embodiment, the present disclosure provides an apparatus wherein the collection medium is a salt flux and the salt has a specific gravity which is lower than that of the condensed droplets or particles so that in operation the condensed matter settles into a portion of the bath below the liquid. In yet another embodiment, an apparatus is disclosed wherein means are provided for continuously moving the collection medium through a location at which the beam impinges onto the collection medium. In yet another embodiment, means are provided for forming a sheet of travelling collection medium on which the beam of condensed vapour impinges. In yet another embodiment, a means for forming a sheet comprises a collection medium bath which is provided with a weir or ledge over which the liquid collection medium can flow.

In another embodiment, the present disclosure provides an apparatus, wherein a nozzle is disposed so as to direct the beam of droplets or particles onto a veil or stream of liquid falling under gravity from the weir. In yet another embodiment, the nozzle is disposed so as to direct the beam of droplets or particles generally horizontally with respect to the collection medium. In yet another embodiment, means are provided for re-circulating collection medium into the bath after overflowing the weir or ledge. In still another embodiment, the collection medium is disposed in a bath and means are provided for circumferentially stirring the collection medium. In still a further embodiment, the liquid is circulated by a mechanical means, such as a stirrer.

In one embodiment, the present disclosure provides an apparatus, wherein the source of vapour provides reactive and/or carrier gases in addition to the vapour to be condensed. In another embodiment, the nozzle can be configured so that on exiting the nozzle the droplets or particles form a first cone and the carrier and/or reactive gases form at least one further cone, the angle of divergence of the first cone being less than an angle of divergence of the second cone, so that the first cone is inside the second cone. In yet another embodiment, a baffle means can be provided at a location so that it is disposed around the first cone and inside the second cone so as to provide a physical barrier which helps isolate the carrier and reactive gases from the condensed droplets or particles which pass through the baffle means into the collection medium. In a further embodiment, the baffle means can be disposed around the location at which the beam of condensed particles or droplets impinges the collection medium. In yet another embodiment, the baffle means comprises an axially elongate conduit, the walls of which provide separation of the first cone. In still another embodiment, the baffle means is surrounded by a shoulder region which covers at least a portion, or all of, the remaining surface of collection medium.

In another embodiment, the present disclosure provides an apparatus wherein the nozzle is configured and/or oriented so that the beam of droplets or particles impinges onto the collection medium at an oblique angle with respect to the medium surface. In yet another embodiment, the collection medium is disposed in a bath and the obliquely oriented beam impinges onto the collection medium at a location radially spaced apart from a central rotational axis of medium in the bath, so that the momentum thereby transferred to the collection medium assists or cause circumferential flow of the collection medium in the bath. In still another embodiment, the nozzle is symmetric about a longitudinal rotational axis. In yet another embodiment, the nozzle is elongate in a transverse direction so that the beam of droplets or particles is provided in a generally planar or wedge-shaped form and so that the beam impinges onto the collection medium along an elongate contact region.

In one embodiment, the present disclosure provides an apparatus, wherein means are provided for tapping the condensed liquid continuously or intermittently from the collection medium and conveying the liquid metal to a casting stage or alloying stage or other metal forming or deposition stage. In yet another embodiment, the condensing chamber is provided with cooling means for removing heat from the collection medium. In yet another embodiment, the liquid collection medium comprises a thin sheet of a first liquid disposed above a second liquid, the sheet being sufficiently thin to be disrupted by impinging condensed droplets or particles, to the extent that the sheet parts in a region corresponding to the impingement so as to reveal a surface of the second liquid and permit direct access of the condensed particles or droplets to the underlying second liquid for absorption therein, and wherein the thin sheet remains as a protective covering over a remaining portion of the surface of the second liquid. In another embodiment, the first liquid comprises a salt flux. In still another embodiment, the second liquid comprises condensed vaporous material. In still another embodiment, the second liquid is a molten metal, such as magnesium.

Following is a description, by way of example only and with reference to the drawings, of modes for putting the invention into effect.

FIRST EMBODIMENT

Figure 1:
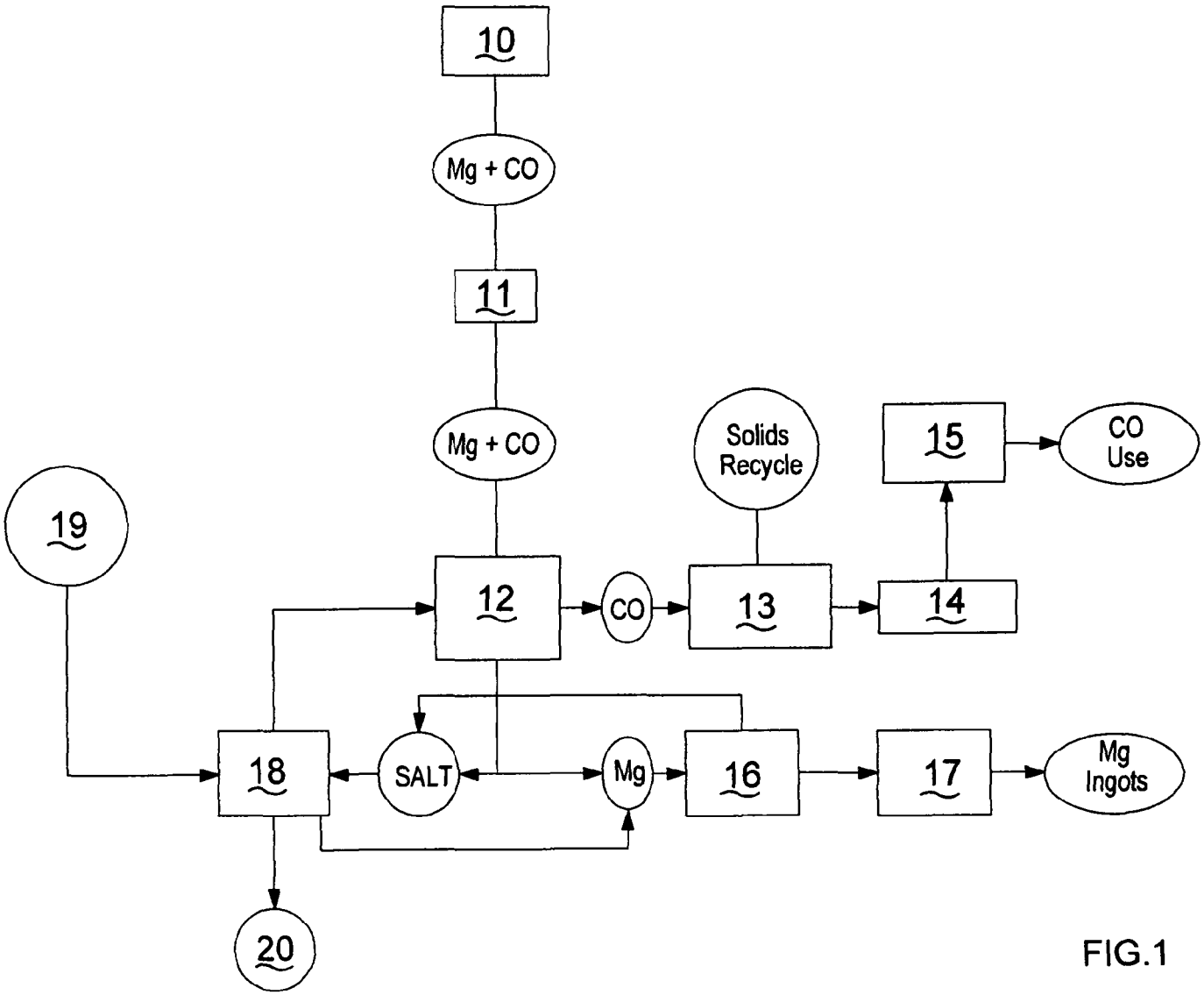
FIG. 1 is a flow chart scheme for an integrated magnesium extraction and casting process which utilises the vapour condensation process and apparatus of the present invention.

As shown in FIG. 1 a carbothermic reduction furnace flue (10) feeds a mixture of magnesium vapour and carbon monoxide to the de Lavalle nozzle (11) of a condensing chamber (described hereinafter in more detail with reference to FIGS. 2 to 5. The nozzle directs Mg mist (liquid droplets) and carbon monoxide reaction gas to impinge upon a molten salt bath collector (12). Carbon monoxide is diverted to a condensate trap/demister (13) known in the art. Metal solids entrained in the CO are recycled. Carbon monoxide is drawn into trap (13) via a vacuum pump (14) and/or steam ejectors. The collected CO is compressed for use by means of a compressor (15). The primary function of the trap is to move any liquid droplets and particulates from the gas phase to protect the vacuum pump or ejectors.

Molten magnesium is tapped from a bottom end of the collector and conveyed to a magnesium settling furnace (16). Any molten salt coveyed with the metal is tapped away to a salt settling furnace (18). The molten magnesium is then conveyed to a casting stage (17) for casting into ingots.

Molten salt is continuously tapped from the collector (12) and conveyed to the settling furnace where any stray magnesium is tapped away and returned to the magnesium settling furnace (18). Fresh salt (19) is pre-heated and fed into the settling furnace. Excess salt may be removed via a bleed valve (20). Salt is returned from the furnace (18) to the salt bath collector (12).

The condenser chamber and nozzle are described in more detail with reference to the FIG. 2. The condenser chamber 99 is a generally cylindrical vessel having frusto-conical upper and lower ends. The carbon monoxide and magnesium vapour enters the upper convergent entry 100 of nozzle 110. The gas mixture is accelerated to supersonic speed in the core of the nozzle and then expands and cools in the lower divergent exit 101 of the nozzle. The gas mixture expands in a focussed double cone shape (not shown) with a common top point almost coinciding with the apex of the divergent cone-shaped expansion exit of the nozzle. An inner cone is substantially made up of magnesium mist and an outer coaxial cone is substantially made up of carbon monoxide.

Due to the phase change from gas to liquid, the metal part of the gas stream will collapse towards the centre of the stream into a cone-shaped, focused metal mist on exiting the nozzle thus pushing the carbon monoxide, or any other gas, to the outside of the stream. This focus of the metal causes it to impinge onto the central portion of the bath through the aperture 107.

An annular flange disc 104 covers the upper surface of a molten salt bath 105. The composition of the salt bath is discussed hereinafter. An upstanding cylindrical baffle 106 surrounds a central aperture 107 in the flange disc. The baffle is sized and located to lie just outside the magnesium metal cone (not shown) so that the walls are not being impinged on directly by magnesium metal drops or solids.

The walls of baffle 106 will however cut off the major part of the CO gas jet stream, thus avoiding an intimate mixture between the two components. This helps reduce any back reaction. The carbon monoxide diverted outside of the baffle is drawn out to via vacuum pump 114.

A lower end of the baffle feeds via the aperture 107 into an exposed upper surface 108 of a molten salt bath designated "circulating salt bath". The magnesium mist thus impacts the salt bath and coalesces into droplets which fall down to a lower region of the vessel.

Figure 2:
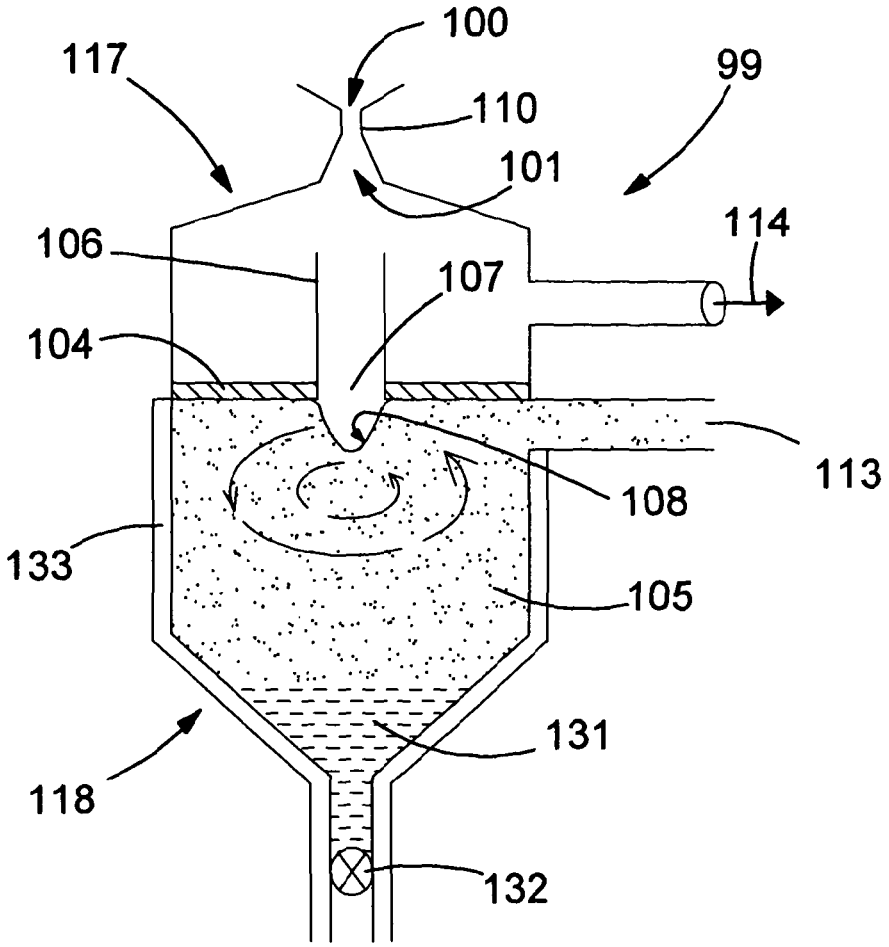
FIG. 2 is a schematic representation of a condensation chamber according to a first embodiment of the invention.

The effective angle of impact of the metal mist on to the surface of the liquid salt may be adjusted by adjusting the speed of rotation of the salt bath, FIG. 2. The surface of the salt bath will ideally, through the rotation, assume the form of a depressed elliptic paraboloid 130. Thus the metal mist impacts at an oblique angle represented by the incline of the salt bath depressed profile.

Thus, when the rotational axis is aligned with the axis of symmetry of the nozzle, the angle of impact of the cone-shaped metal mist depends on the shape of the paraboloid. This in turn is controlled by the rotational speed of the molten salt. The salt surface contour shape will, at slow speeds, assume a wide opening paraboloid and a steeper shaped paraboloid on increased rotational speed.

Molten magnesium 131 settles to a lower portion of the salt bath due to its higher specific gravity. This may be tapped off under gravity by opening of a tap valve 132.

A double skin water cooling jacket vessel 133 surrounds the salt bath to provide external cooling and temperature control. The vessels can be made from steel or nickel alloys. Water, stream, synthetic heat transfer liquids such as Dowtern, liquid metals such as mercury, or other suitable materials. These can be used inside the jackets to remove heat from the salt and keep it at a temperature which is suitable to remove the energy dissipated when the metal stream impacts the salt bath.

The condenser chamber is equipped with a heater (not shown), which can be internal or external of the condenser chamber. This is for temperature control of the salt during start up and shut down of the unit. Under steady state operation, the heater will be off as heat is provided from the vapour entering the system.

SECOND EMBODIMENT

Figure 3:
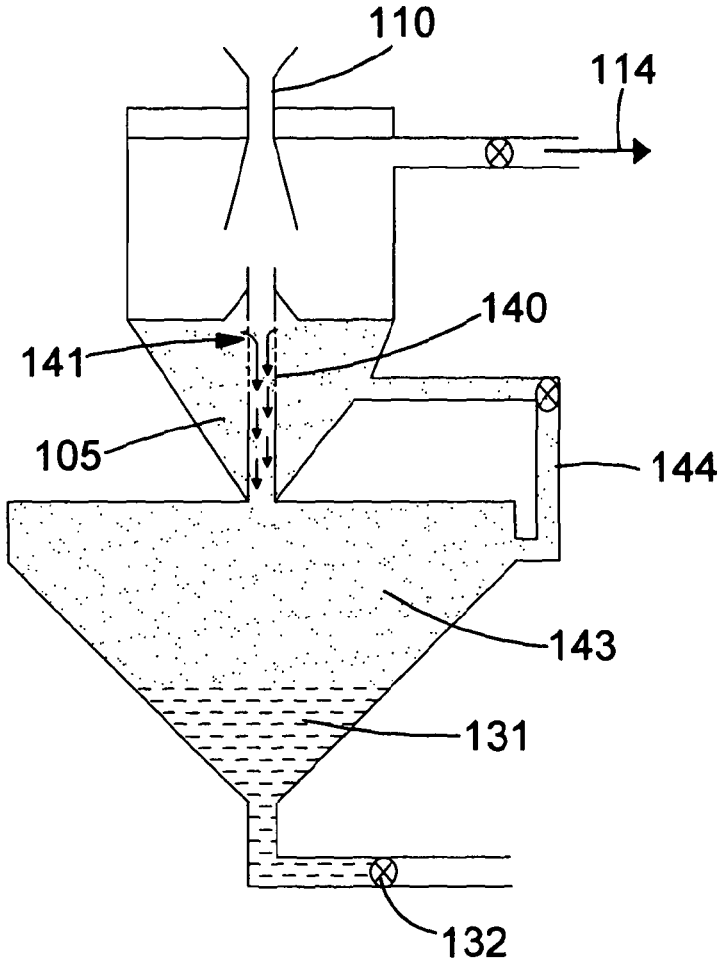
FIG. 3 is a schematic representation of a condensation chamber according to a second embodiment of the invention.

In FIG. 3 an alternative embodiment is shown in which like features are given the same numbers as used in relation to FIG. 1. In this embodiment an upstanding perforated tube 140 is disposed in a centre region of the salt bath. The molten salt surrounds the tube. A void is present in the tube (at the ambient gas pressure of the upper gas chamber). An upper region 141 of the tube is formed with apertures or perforations which allow molten salt to cascade down the interior of the tube. Salt is continuously pumped up from a lower salt reservoir 143 via conduit 144. This maintains the salt level in bath 105, notwithstanding the volumes descending in the tube 140.

The magnesium mist cone beam is directed into the interior of the tube and impacts on the continuously falling molten salt. The magnesium then falls via the tube into the lower salt reservoir 143 and settles as a coalesced mass of liquid magnesium 131.

This arrangement ensures that a constantly moving surface or veil of falling salt is provided on which the mist beam can impinge onto. The gas evacuated through the gas ducts is scrubbed of entrained magnesium droplets or particles in a separate unit.

THIRD EMBODIMENT

Figure 4:
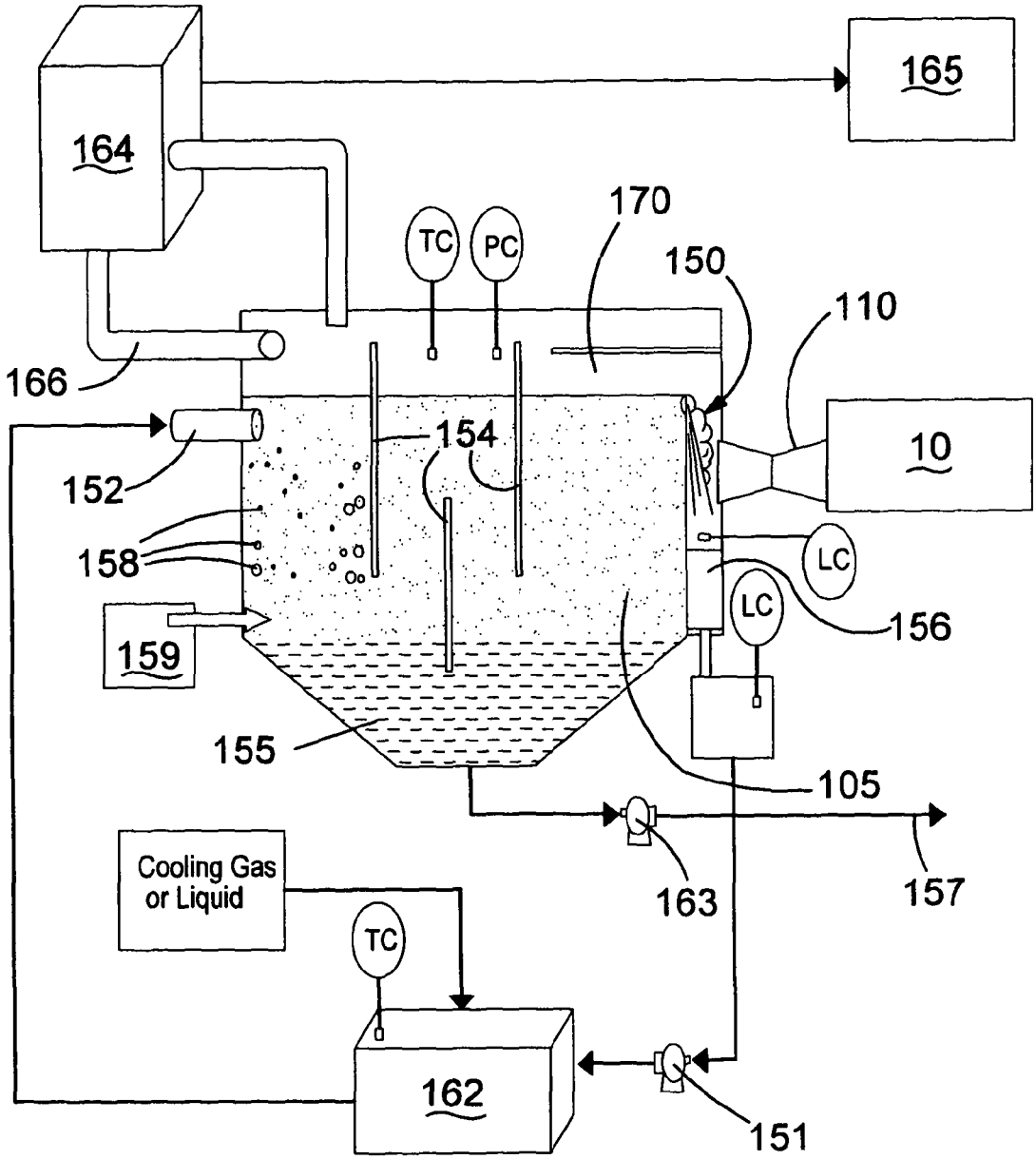
FIG. 4 is a schematic representation of a condensation chamber and ancillary apparatus in accordance with a third embodiment of the invention.

In FIG. 4 a third embodiment is shown in which a salt bath is provided with an overflow weir 150. The nozzle enters the condensing chamber in a radial transverse direction. Thus a mist beam impinges onto the sheet or veil of moving salt cascading over the weir. The salt and entrained solid or liquid magnesium particles fall into a weir pool 156 below the weir. The mixture is continuously fed from the weir pool into the salt bath at an inlet 152 via salt pump 151 and a heat exchanger 152 which extracts heat from the salt. Metal droplet 158 feed into the salt bath along with the salt.

Baffles 154 define a tortuous path for the salt from the inlet to the weir 150. The baffles 154 provide obstructions and surfaces upon which entrained magnesium may coalesce and then fall to a lower portion 155 of the bath. The magnesium may be pumped from the lower portion to a magnesium settling furnace 157.

Salt level control sensors/controllers (LC) and temperature (TC) and pressure (PC) sensors/controllers are provided to maintain the required levels, temperatures and pressures.

A salt make-up feeder 159 may be used to adjust the salt composition within the required specification (cf. table 1).

FORTH EMBODIMENT

Figure 5:
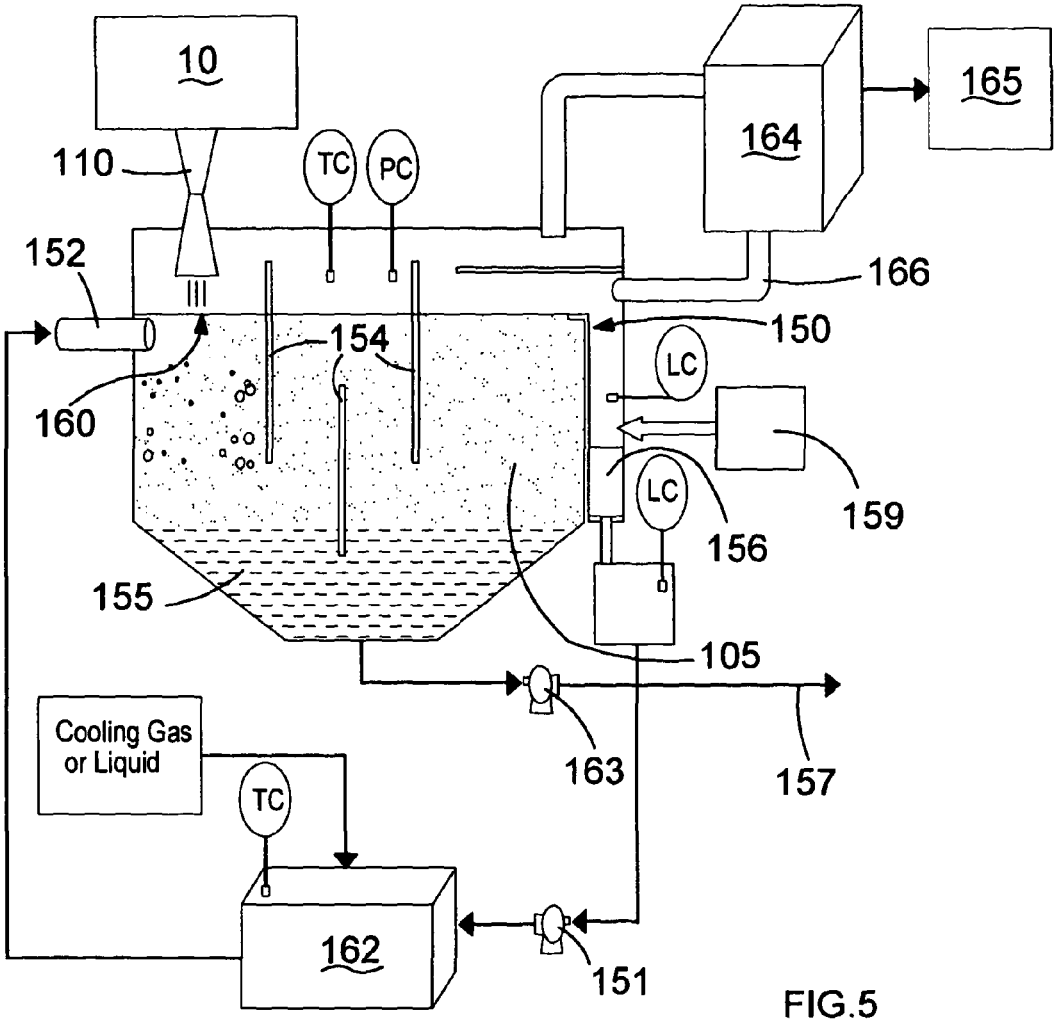
FIG. 5 is a schematic representation of a condensation chamber and ancillary apparatus in accordance with a forth embodiment of the invention.
Figure 6:
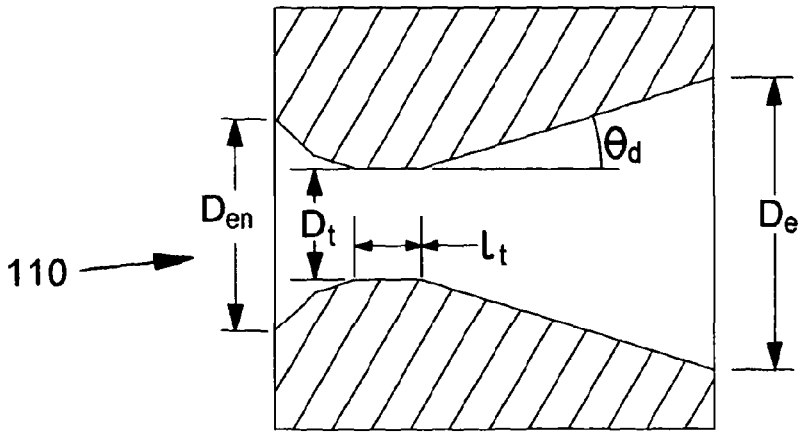
FIG. 6 is longitudinal cross-section through an annular de LaValle nozzle.

FIG. 5 shows another embodiment which is a variation of the embodiment of FIG. 4. In this embodiment the nozzle 110 is directed to generate a beam which is directed onto an outer circumferential region 160 of the salt bath. The nozzle may be directed at an oblique angle to the salt bath surface so as to promote circumferential circulation. Overflow from weir 150 and the action of return pump 151 provides a further circulation of salt in the bath.

For all embodiments this invention includes secondary vessel(s) as required for (1) the settling of magnesium particles or droplets from the fused salt, (2) heat control, and (3) removal of particulates and droplets from the gas stream to enhance recoveries and to protect downstream equipment.

FIFTH EMBODIMENT

Figure 7:
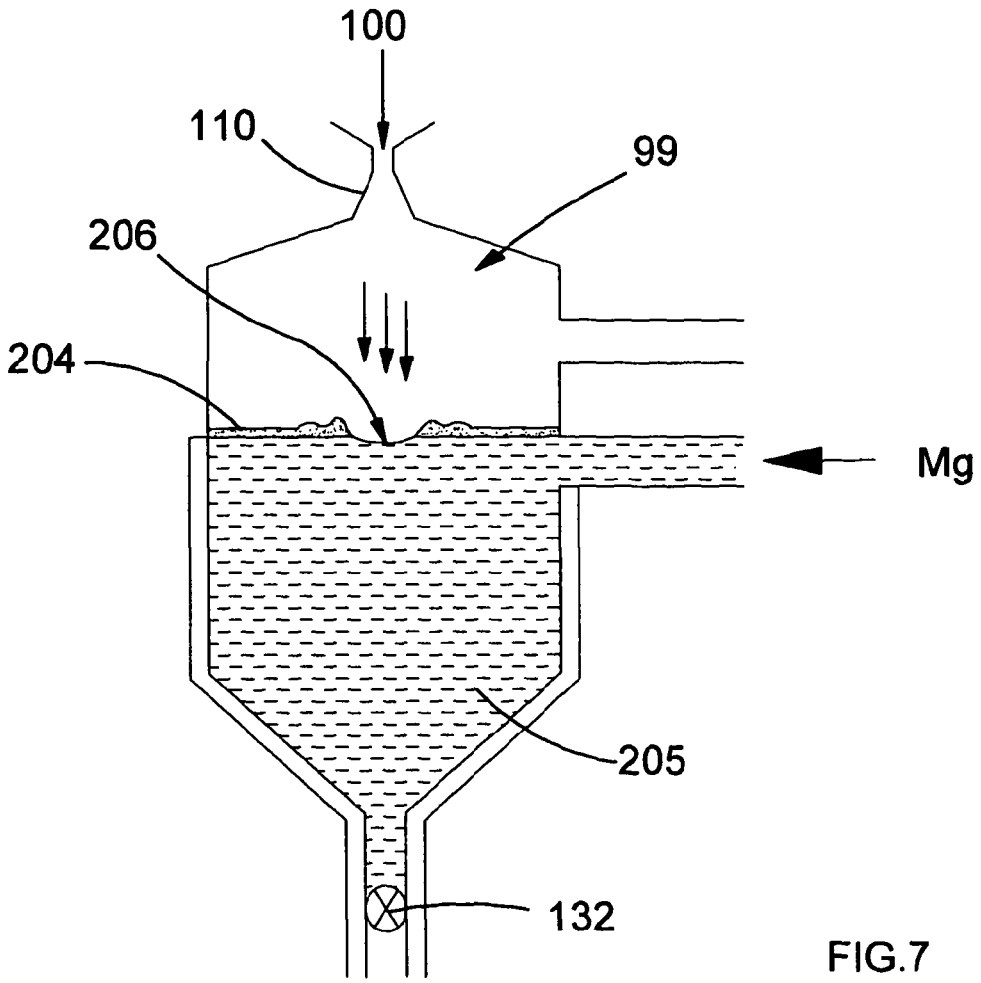
FIG. 7 is a schematic representation of an embodiment of the invention having no baffle or cylindrical plate.

The fifth embodiment is shown in FIG. 7 and is a variant of the arrangement shown in the first embodiment of the invention in FIG. 2. In this embodiment there is no baffle or cylindrical plate. The bulk of the collection medium comprises molten metal (magnesium) 205. A relatively thin layer of salt flux (204) is disposed on the upper surface of the molten metal. In use the beam of droplets or particles exiting from the nozzle 110 impinges on the collection medium and disrupts the salt flux layer so as to expose underlying molten metal. Thus, after start-up, the beam impinges directly onto the revealed molten metal surface 206 in the central region of the condensing chamber. The salt flux remains covering the remainder of the molten metal around the centre and provides a protective layer which prevents oxidation or contamination of the underlying metal.

SIXTH EMBODIMENT

Figure 8:
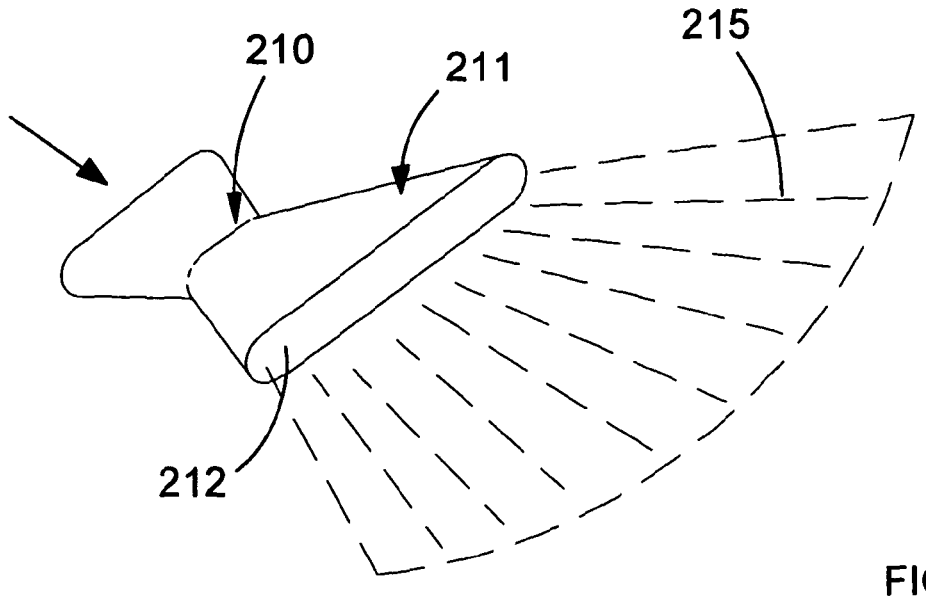
FIG. 8 is a schematic representation of an embodiment of the invention having an axially asymmetric nozzle, a transversely elongate waist, and a divergent skirt portion.

The sixth embodiment is shown in FIG. 8 which is an alternative nozzle arrangement. The nozzle is axially asymmetric, and includes a transversely elongate waist 210 and divergent skirt portion 211. The skirt portion defines a generally oblong exit orifice 212 of the nozzle. This configuration provides a generally planar or wedge shaped beam (215) of condensed droplets or particles. Thus the beam impinges upon an associated collection medium (not shown) along a length thereof, rather than at a point. This asymmetric nozzle may be used in any of the preceding embodiments in place of a conventional symmetric nozzle. It is however particularly suited to the arrangement shown in FIG. 4 in which a travelling sheet or veil 150 of collection medium is provided to collect the condensed droplets or particles impinging thereon. In this case the beam is directed to impinge transversely across the falling sheet, whereby efficient adsorption of the metal particles/droplets may take place.

The invention claimed is:

1. A method for condensing a vaporous material comprising:

providing a gas stream comprising the vapour, passing the gas stream through a nozzle which has an upstream converging configuration and a downstream diverging configuration so that the vapour accelerates into the nozzle and expands and cools on exiting the nozzle thereby inducing the vapour to condense to form a beam of liquid droplets or solid particles in the condensing chamber, wherein the beam of droplets or particles is directed to impinge onto a bath of molten liquid collection medium, wherein the collection medium is maintained at a temperature above the melting point of the condensed vaporous material, and wherein the collection medium comprises a salt flux which has a specific gravity lower than that of the condensed vaporous material.

2. The method of claim 1, wherein the nozzle has an elongate transverse waist region so as to provide a generally planar or wedge-shaped output beam of condensed particles or liquid.

3. The method of claim 1, wherein the gas stream comprises reaction gas and/or a non-reactive carrier gas in addition to the vapour to be condensed.

4. The method of claim 1, wherein the beam of droplets or particles impinges onto the collection medium at an oblique angle with respect to a surface of the collection medium.

5. The method of claim 4, wherein the oblique beam impinges onto the collection medium at a location radially spaced apart from a central rotational axis of the bath, thereby assisting or causing circumferential flow of the molten bath.

6. The method of claim 1, wherein metal droplets in the beam are cooled to form solid particles before impinging on the collection medium.

7. The method of claim 1, wherein the collection medium is cooled so as to prevent liquid metal from the beam vaporizing.

8. The method of claim 1, wherein the vaporous material to be condensed comprises magnesium.

9. The method of claim 1, wherein the vapour comprises a metal or metallic material.

10. The method of claim 9, wherein the vapour is a metal comprising Mg, Zn, Sn, Pb, As, Sb, Bi, Si, Cd, or a combination thereof.

11. The method of claim 9, wherein the vapour is provided by a metallothermic or carbothermic reduction apparatus and/or process.

12. A method for condensing a vaporous material comprising:

providing a gas stream comprising the vapour, passing the gas stream through a nozzle which has an upstream converging configuration and a downstream diverging configuration so that the vapour accelerates into the nozzle and expands and cools on exiting the nozzle thereby inducing the vapour to condense to form a beam of liquid droplets or solid particles in the condensing chamber, wherein the beam of droplets or particles is directed to impinge onto a molten liquid collection medium, wherein the liquid collection medium comprises a thin sheet of a first liquid disposed above a second liquid, the sheet being sufficiently thin to be disrupted by impinging condensed droplets or particles, to an extent that the sheet parts in a region corresponding to the impingement so as to reveal a surface of the second liquid so as to permit direct access of the condensed particles or droplets to the underlying second liquid for absorption therein, and wherein the thin sheet remains as a protective covering over a remaining portion of the surface of the second liquid.

13. The method of claim 12, wherein the first liquid comprises a salt flux.

14. The method of claim 12, wherein the second liquid comprises liquid condensed vaporous material.

15. The method of claim 12, wherein the second liquid is a molten metal.

16. A method for condensing a vaporous material comprising:

providing a gas stream comprising the vapour, passing the gas stream through a nozzle which has an upstream converging configuration and a downstream diverging configuration so that the vapour accelerates into the nozzle and expands and cools on exiting the nozzle thereby inducing the vapour to condense to form a beam of liquid droplets or solid particles in the condensing chamber, wherein the beam of droplets or particles is directed to impinge onto a molten liquid collection medium, wherein the collection medium comprises a moving sheet of liquid.

17. The method of claim 16, wherein the moving sheet is a stream of liquid falling under gravity.

18. The method of claim 16, wherein the moving sheet is provided by an overflowing ledge region of a collection medium reservoir.

19. The method of claim 16, wherein the nozzle is directed horizontally or substantially horizontally towards the sheet of liquid collection medium.

20. A method for condensing a vaporous material comprising:

providing a gas stream comprising the vapour, passing the gas stream through a nozzle which has an upstream converging configuration and a downstream diverging configuration so that the vapour accelerates into the nozzle and expands and cools on exiting the nozzle thereby inducing the vapour to condense to form a beam of liquid droplets or solid particles in the condensing chamber, wherein the beam of droplets or particles is directed to impinge onto a molten liquid collection medium, wherein the collection medium is disposed as a circumferentially circulating bath of liquid.

21. The method of claim 20, wherein the liquid is circulated by a mechanical means.

22. A method for condensing a vaporous material comprising:

providing a gas stream comprising the vapour, passing the gas stream through a nozzle which has an upstream converging configuration and a downstream diverging configuration so that the vapour accelerates into the nozzle and expands and cools on exiting the nozzle thereby inducing the vapour to condense to form a beam of liquid droplets or solid particles in the condensing chamber, wherein the beam of droplets or particles is directed to impinge onto a molten liquid collection medium, wherein on exiting the nozzle the condensed droplets or particles form a first cone, the reaction gas and/or carrier gas form at least one further cone with the first cone accommodated inside the second cone and wherein a baffle means is provided around the first cone and substantially inside the further cone so as to provide a physical barrier which helps separate the carrier gas and other remaining gaseous species from the droplets or particles which pass through the baffle into the collection medium.

23. The method of claim 22, wherein the baffle means comprises an axially elongate conduit having walls which provide separation of the first cone.

24. The method of claim 23, wherein the baffle means is surrounded by a shoulder which covers at least a portion or all of a remaining surface of collection medium.

25. A method for condensing a vaporous material comprising:

providing a gas stream comprising the vapour, passing the gas stream through a nozzle which has an upstream converging configuration and a downstream diverging configuration so that the vapour accelerates into the nozzle and expands and cools on exiting the nozzle thereby inducing the vapour to condense to form a beam of liquid droplets or solid particles in the condensing chamber, wherein the beam of droplets or particles is directed to impinge onto a molten liquid collection medium, wherein the beam of droplets or particles impinges onto the collection medium at an oblique angle with respect to the medium surface, and wherein the collection medium is disposed in a circumferentially circulating molten bath.

26. The method of claim 25, wherein the bath circulation induces an inverted coaxial centrifugal cone to form in an upper surface of the bath, which cone provides an oblique surface to receive the droplet or particle beam.

27. A method for condensing a vaporous material comprising:

providing a gas stream comprising the vapour, passing the gas stream through a nozzle which has an upstream converging configuration and a downstream diverging configuration so that the vapour accelerates into the nozzle and expands and cools on exiting the nozzle thereby inducing the vapour to condense to form a beam of liquid droplets or solid particles in the condensing chamber, wherein the beam of droplets or particles is directed to impinge onto a molten liquid collection medium, wherein the collection medium comprises a liquid having a lower specific gravity than the condensed liquid material, which condensed liquid material is continuously or intermittently tapped from a collection medium reservoir and directed without intermediate solidification to a casting stage or alloying stage or other forming stage.

* * * * *